US010053199B2

(12) United States Patent
Smith

(10) Patent No.: US 10,053,199 B2
(45) **Date of Patent: *Aug. 21, 2018**

(54) MULTI-PURPOSE COLLASPIBLE PERSONAL WATERCRAFT

(71) Applicant: Robin Smith, Moreno Valley, CA (US)

(72) Inventor: Robin Smith, Moreno Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/607,637

(22) Filed: May 29, 2017

(65) Prior Publication Data

US 2017/0259889 A1 Sep. 14, 2017

Related U.S. Application Data

(63) Continuation-in-part of application No. 14/715,695, filed on May 19, 2015, now Pat. No. 9,663,209.

(51) Int. Cl.

| | |
|---|---|
| ***B63B 17/00*** | (2006.01) |
| ***B63H 20/00*** | (2006.01) |
| ***B63B 7/02*** | (2006.01) |
| ***B63B 35/78*** | (2006.01) |
| ***B63H 16/08*** | (2006.01) |
| ***B63B 35/73*** | (2006.01) |
| *B63B 7/00* | (2006.01) |

(52) U.S. Cl.

CPC ..... *B63H 20/007* (2013.01); *B63B 7/02* (2013.01); *B63B 35/73* (2013.01); *B63B 35/78* (2013.01); *B63H 16/14* (2013.01); *B63B 2007/006* (2013.01); *B63B 2035/738* (2013.01)

(58) Field of Classification Search

CPC ..... B63H 16/12; B63H 16/14; B63H 20/007; B63H 25/06; B63H 25/08; B63H 25/38; B63B 3/26; B63B 3/48; B63B 7/00; B63B 7/02; B63B 7/04; B63B 35/00; B63B 35/73; B63B 35/731; B63B 2003/265; B63B 2003/485

USPC ..... 114/343, 352, 354, 363, 364

See application file for complete search history.

(56) References Cited

U.S. PATENT DOCUMENTS 3,303,520 A * 2/1967 Bachley ..... B63C 13/00 114/344

4,337,543 A * 7/1982 Van Ulzen ..... B63B 1/14 114/123

4,694,770 A * 9/1987 Kitner ..... B63B 35/731 114/123

(Continued)

*Primary Examiner* — Daniel V Venne

(74) *Attorney, Agent, or Firm* — The Keys Law Firm, PLLC

(57) ABSTRACT

A multi-purpose personal watercraft for deployment in different configurations as desired by a user. The multi-purpose personal watercraft comprises a base frame which forms a watercraft base which includes side extensions, an aft floor board, and a bow portion, as well as two opposing mirror image side floats with which the base frame is selectively integrated. When in place, the opposing side floats form the multi-purpose personal watercraft's U shaped hull and enable the selective attachment of a rudder assembly behind the multi-purpose personal watercraft's stern. With respect to propulsion, base frame is configured to enable the selective deployment of pedal propellers, a user's legs, or a trolling motor. A dual steering system enables the control of up to two discrete steering mechanisms from a single position on the watercraft.

14 Claims, 7 Drawing Sheets

(56) References Cited

U.S. PATENT DOCUMENTS

| | | | | |
|---|---|---|---|---|
| 5,239,940 | A * | 8/1993 | Griffin | B63B 7/02 114/353 |
| 5,522,339 | A * | 6/1996 | Pelly | B63B 1/12 114/354 |
| 5,617,810 | A * | 4/1997 | Sauerwein | B63B 7/04 114/123 |
| 5,651,706 | A | 7/1997 | Kasper | |
| 6,334,402 | B1 * | 1/2002 | Gilligan | B63B 7/082 114/345 |
| 6,367,405 | B1 | 4/2002 | Smiley | |
| 6,564,735 | B1 * | 5/2003 | Jackson | B63B 35/36 114/353 |
| 6,988,456 | B1 * | 1/2006 | Schooler | B63B 1/125 114/344 |
| 7,549,902 | B2 | 6/2009 | Jansen | |
| 8,316,788 | B2 | 11/2012 | Willis | |
| 8,656,856 | B1 | 2/2014 | Morrow | |
| 8,757,185 | B1 | 6/2014 | Muzzio | |
| 8,783,205 | B1 | 7/2014 | Kocher | |
| 2012/0238159 | A1 | 9/2012 | Palvoelgyi et al. | |

* cited by examiner

MULTI-PURPOSE COLLASPIBLE PERSONAL WATERCRAFT

CROSS REFERENCE TO RELATED APPLICATIONS

This application is a continuation in part of, claims the benefit of, and incorporates by reference U.S. patent application Ser. No. 14/715,695, filed May 19, 2015, now U.S. Pat. No. 9,663,209.

BACKGROUND OF THE INVENTION

Field of the Invention

This invention relates generally to personal watercraft apparatus and, more particularly, to a multi-purpose, collapsible personal watercraft having plural propulsion means and which is suitable for fishing.

Description of the Prior Art

The use and design of conventional personal watercraft apparatus is well known. A problem which still exists, however, is that conventional personal watercraft apparatus are generally a fixed size and optimized for only one thing, speed. A boater who enjoys riding a personal watercraft and also enjoys fishing is often required to have separate boat just for fishing because the personal watercraft is not suited for fishing. Further, even though they are generally smaller than conventional boats, personal watercraft are often no easier to transport that larger fishing boats and/or speed boats. Thus, there remains a need for a multi-purpose personal watercraft that is collapsible when not in use to enable it to more easily stored and transported. It would be helpful if such a multipurpose personal watercraft included multiple configurations employing discrete propulsion mechanisms. It would be additionally desirable for such a multipurpose personal watercraft to include a dual steering system for enabling control of a plurality of propulsion/navigation devices.

The Applicant's invention described herein provides for a multipurpose personal watercraft adapted to provide a easily transported boat structure that can be customized with floats, a rudder and/or propulsion devices. The primary components in Applicant's multi-purpose personal watercraft are a base frame and opposing side floats. When in operation, the multi-purpose personal watercraft enables a user to deploy a single watercraft in various configurations for various purposes. As a result, many of the limitations imposed by prior art structures are removed.

SUMMARY OF THE INVENTION

A multi-purpose personal watercraft for deployment in different configurations as desired by a user. The multi-purpose personal watercraft comprises a base frame defining a watercraft base which includes side extensions, a removable aft floor board, and a bow portion, as well as two opposing side floats with which the base frame is selectively integrated. When in place, the opposing side floats defines form the multi-purpose personal watercraft's U shaped hull and enable the selective attachment of a rudder assembly. With respect to propulsion, base frame is configured to enable the selective deployment of pedal propellers, a user's legs, or a trolling motor. A dual steering system enables the control of up to two discrete steering mechanisms from a single position on the watercraft.

It is an object of this invention to provide a need for a multi-purpose personal watercraft that is collapsible when not in use to enable it to more easily stored and transported.

It is another object of this invention to provide a multi-purpose personal watercraft that includes multiple configurations employing discrete propulsion mechanisms.

It is yet another object of this invention to provide a multipurpose personal watercraft that includes a dual steering system for enabling control of a plurality of propulsion/navigation devices.

These and other objects will be apparent to one of skill in the art.

DETAILED DESCRIPTION OF THE INVENTION

Figure 1:
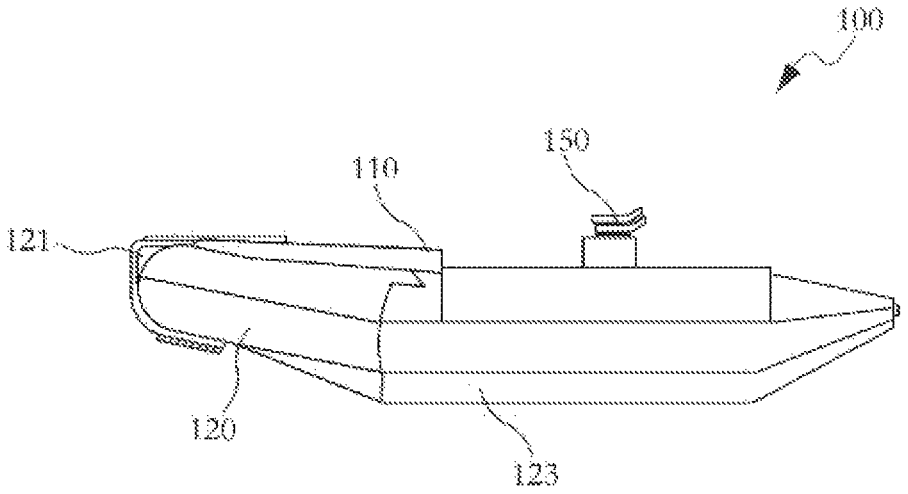
FIG. 1 is a side elevational view of a multi-purpose personal watercraft built in accordance with an embodiment of the present invention in a base assembly.
Figure 2:
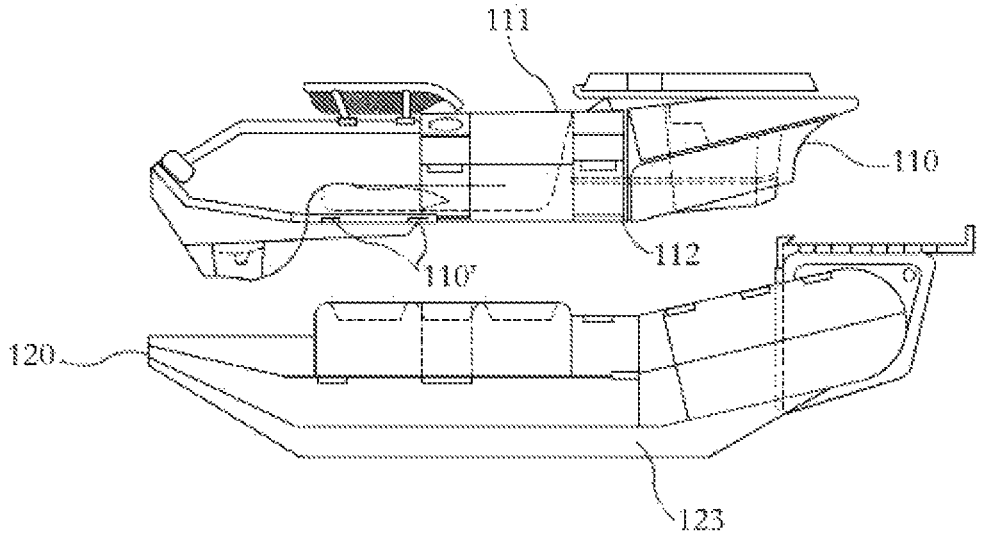
FIG. 2 is an exploded side elevational view of a multi-purpose personal watercraft built in accordance with an embodiment of the present invention.

Referring now to the drawings and in particular FIGS. 1, 2, 3, 3A, 4, 5, 6, 7, 8, 9 and 10, a multi-purpose personal watercraft 100 is shown having a base frame 110 selectively integrated with two opposing side floats 120. The base frame 110 defines a watercraft base having a deck side 111, hull side 112, detachable side extensions 113 and a removable aft floor board 114. Each of the opposing side floats 120 defines a mirror image curved float body formed of rigid plastic and having an attachment plate 121. The respective side floats 120 are each selectively attachable individually, either along the starboard edge of the hull side 112 of the base frame 110 or the port edge of the hull side 112 of the base frame 110, depending on the floats 120. It is contemplated that when the respective side floats 120 are in place on the base frame 110, their respective attachment plates 121 converge with one another and are secured together through the interlock of a plurality of teeth 121' that extend from each respective attachment plate 121. Accordingly, when in use, the side floats 120 form the multi-purpose personal watercraft's 100 U shaped hull.

Advantageously, because the side floats 120 attach individually to the base frame 110, either may be replaced or repaired as needed, without having to replace both. In addition, because the side floats 120 are rigid, items such as a tackle box can be placed in wells 124 on them and retained there while the watercraft is in use. It is additionally noted that when the base frame 110 and side floats 120 are assembled, liftable flaps 118 on the base frame 110 are positioned to selective cover the wells 124.

In the preferred embodiment, the side floats 120 are secured to the base frame 110 through a plurality of float slots 122 on the top surface of the side floats 120 that each correspond to a tabs that extends from the hull side 112 of the base frame 110 and frame slots 110' on the side surface of the base frame 110 that each correspond to tabs that extend from the side floats 120. It is contemplated, however, that in alternate embodiments, the side floats 120 may be secured to the base frame 110 through any conventional attachment device that would allow the side floats 120 to be held in a position flush against the surface of the hull side 112 of the base frame 110.

In one embodiment, each side float 120 includes a float enhancement body 123 sized to run along the length of the side float 120. The float enhancement body 123 is selectively attachable to the bottom of the side float 120 and smoothes the transition between the base frame 110 and the attached side float 120 on the underside of the multi-purpose personal watercraft 100. In one embodiment, each side float 120 is formed from a top float half and a bottom float half which are attached together. In such an embodiment, a single fastening device may be employed to fix together the top float half, bottom float half, and float enhancement body 123.

Figure 9:
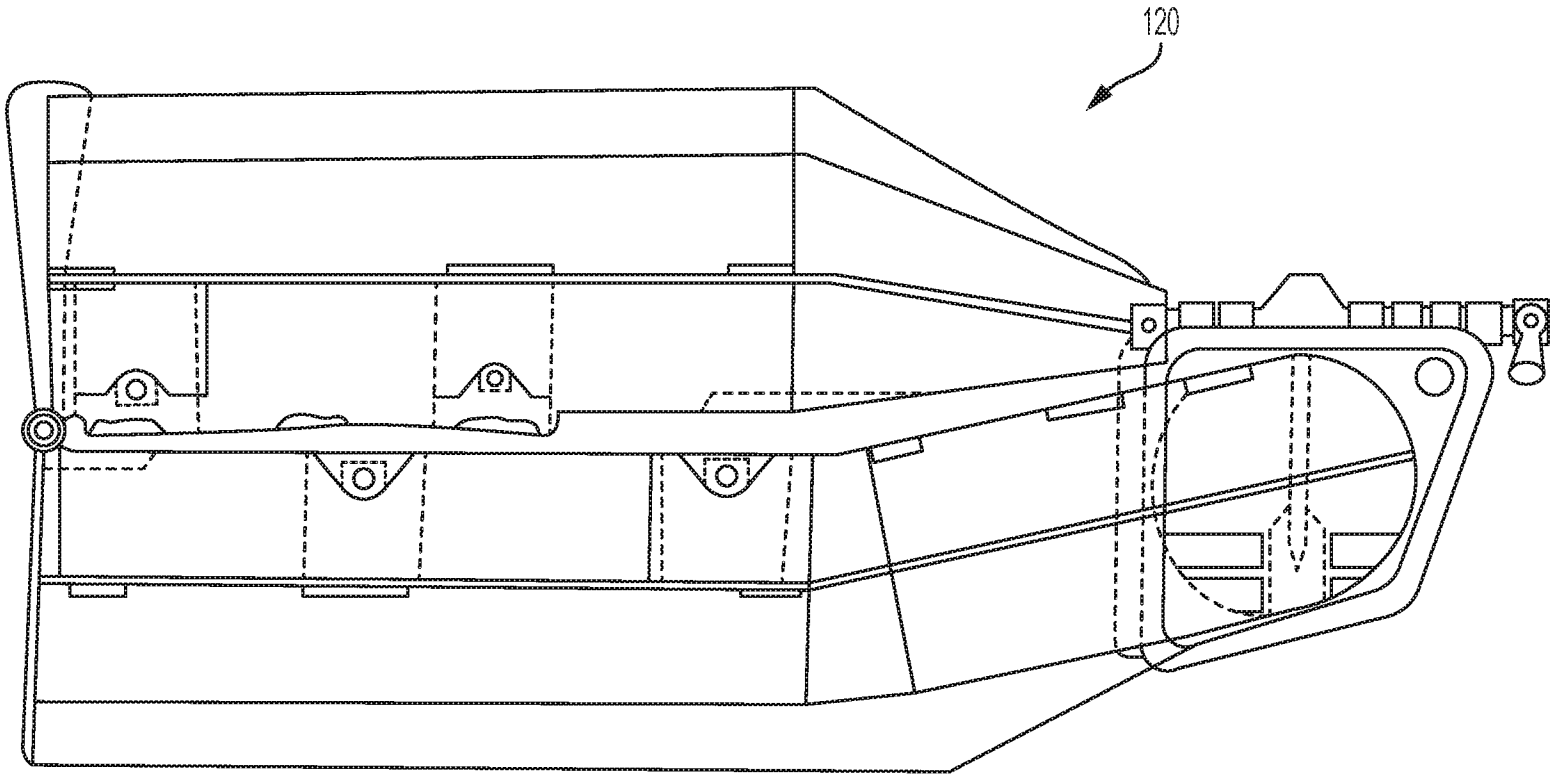
FIG. 9 is a side elevational view of a side float of a multi-purpose personal watercraft built in accordance with the present invention in a folded configuration.
Figure 10:
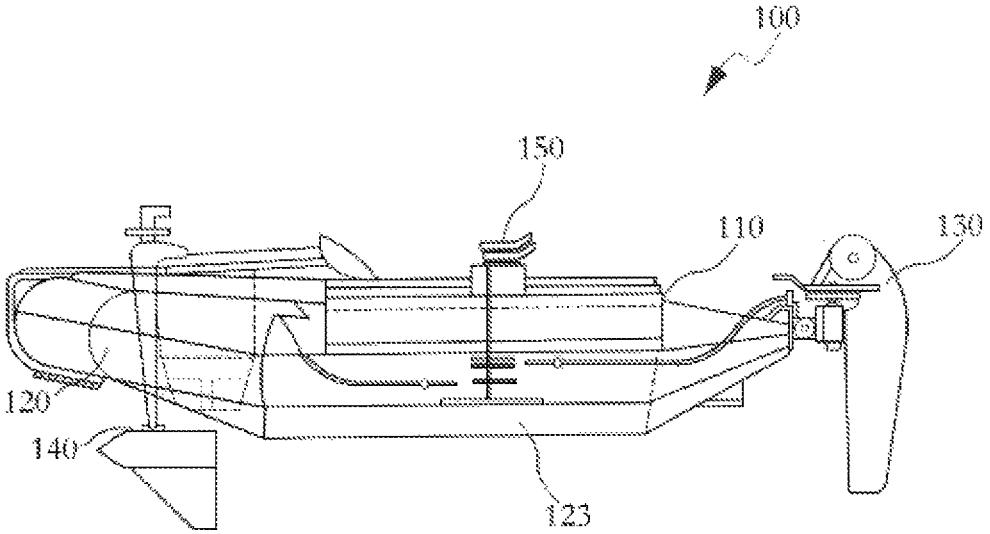
FIG. 10 is a cross section of a side elevational view of a multi-purpose personal watercraft built in accordance with an embodiment of the present invention in a dual steering system.

As illustrated in FIG. 9, in one embodiment, the side floats 120 can be selectively folded in half for storage. In one folding embodiment, the side floats 120 can be folded from four feet in length to two feet in length.

Figure 3:
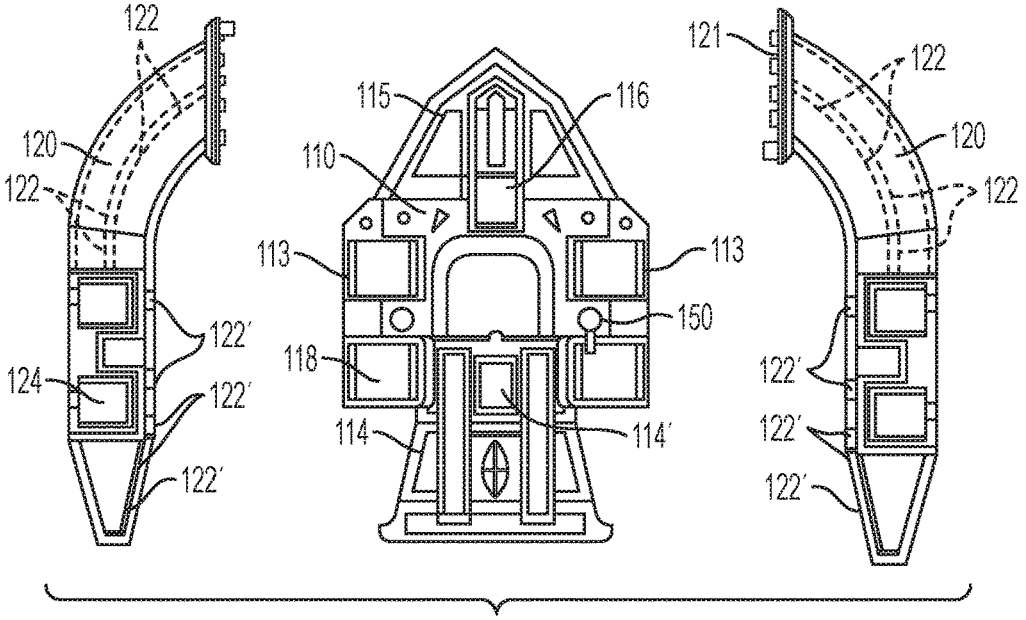
FIG. 3 is an exploded top plan view of a base frame in a deployed configuration and side float of a multi-purpose personal watercraft built in accordance with an embodiment of the present invention.
Figure 3A:
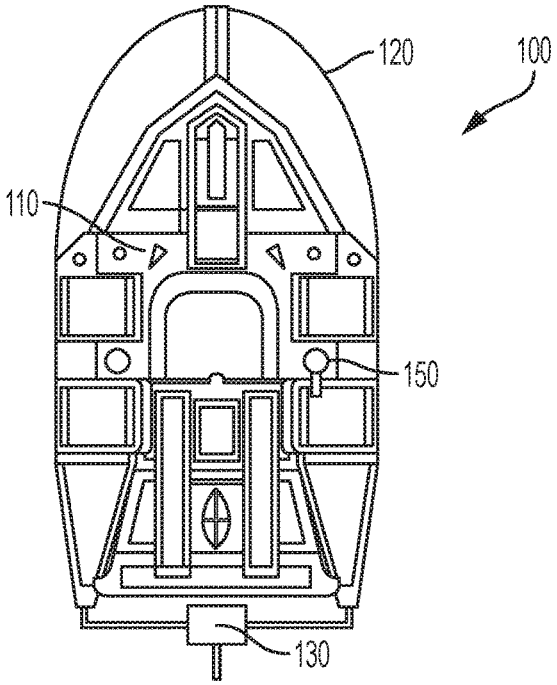
FIG. 3A is a top plan view of a base frame in a deployed configuration and side floats of a multi-purpose personal watercraft built in accordance with an embodiment of the present invention.
Figure 4A:
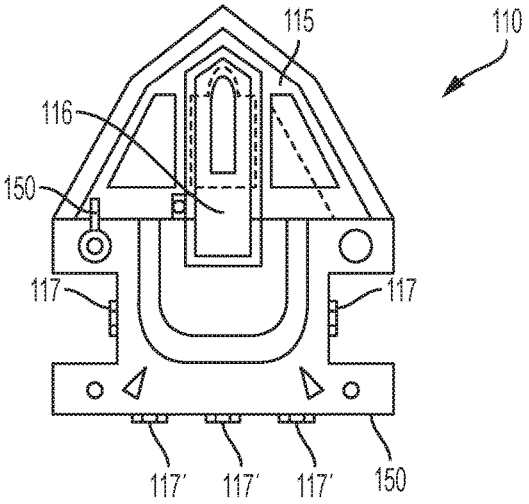
FIG. 4A is a top plan view of a base frame of a multi-purpose personal watercraft built in accordance with the present invention in a storage configuration with the seat shown in a front facing orientation.
Figure 4:
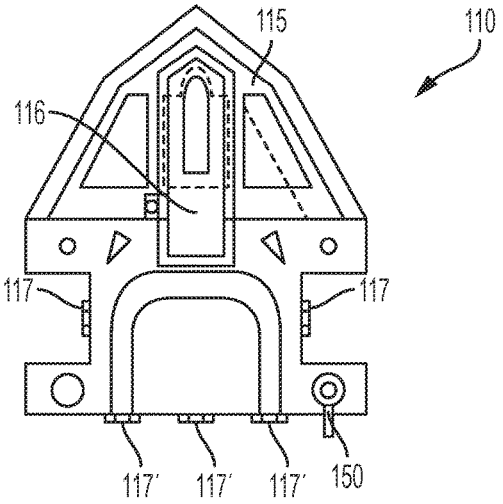
FIG. 4 is a top plan view of a base frame of a multi-purpose personal watercraft built in accordance with the present invention in a storage configuration with the seat shown in a rear facing orientation.
Figure 5:
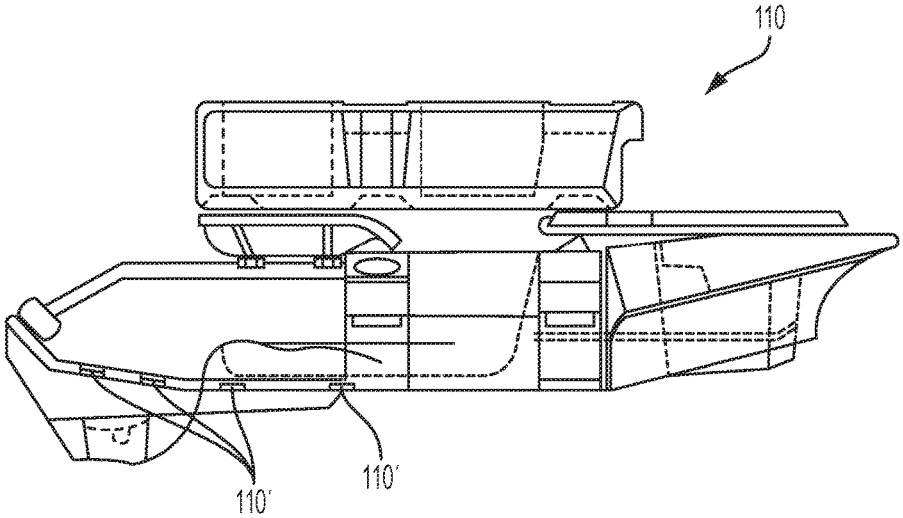
FIG. 5 is a side elevational view of a base frame of a multi-purpose personal watercraft built in accordance with the present invention in a deployed configuration.
Figure 6:
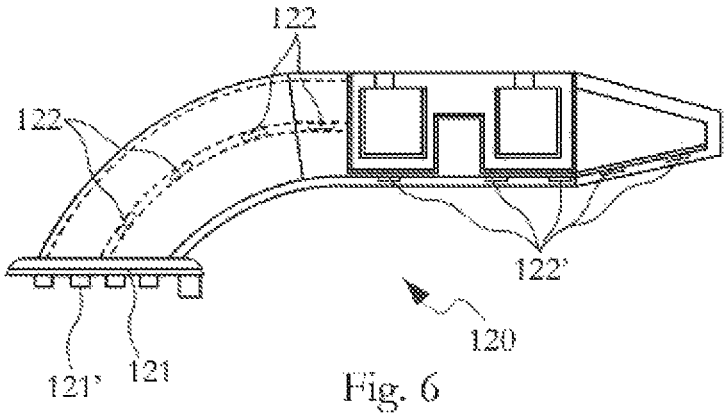
FIG. 6 is a top plan view of a side float of a multi-purpose personal watercraft built in accordance with the present invention in a deployed configuration.
Figure 7:
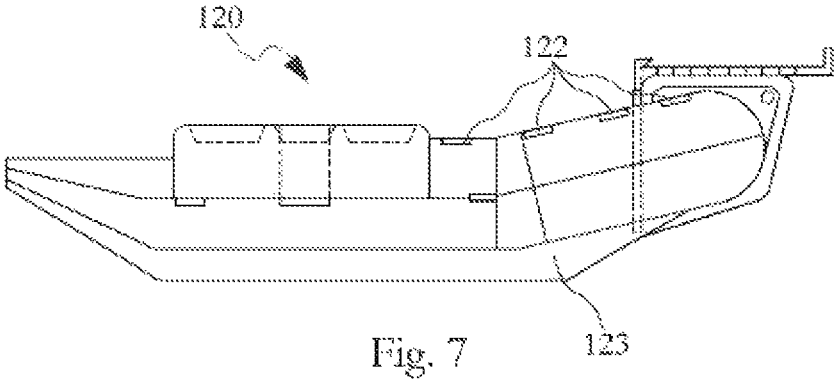
FIG. 7 is a side elevational view of a side float of a multi-purpose personal watercraft built in accordance with the present invention in a deployed configuration.
Figure 8:
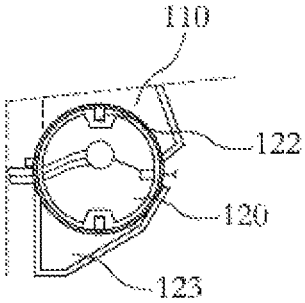
FIG. 8 is a cross section of a front elevational view of a side float of a multi-purpose personal watercraft built in accordance with the present invention in a deployed configuration

The detachable side extensions 113 define planar members that are selectively attachable in a deck position in which they are parallel with the deck of the base frame 110, as shown in FIG. 3. It is contemplated that in one embodiment, a lockable hinge joint 117 such as a conventional rotary lockable hinge or a hinge with locking lever is employed to attach the foldable side extensions 113 such that they can be locked in the deck position. It is appreciated that the lockable hinge 117 has a removable pin so as to allow the side extensions 113 to be detached from the base frame 110. In some embodiments, the side extensions 113 may also be hinged to a storage position in which they are perpendicular with and extending above the deck (i.e. top surface) of the base frame 110. It is understood that the positioning and detachability of the side extensions 113 allows for the size of the base frame's 110 deck to be maximized while still enabling it to be broken down into a more easily portable and storable size.

The aft floor board 114 is selectively attachable to the base frame 110. In the one embodiment, the aft floor board 114 is attachable through a lockable hinge joint 117' having a removable pin (removing the pin allows the aft floor board 114) to be separated from the base frame 110. It is appreciated that when in place, the aft floor board 114 extends the deck of the base frame 110, thereby providing additional space on which to move thereon. On the other hand, by removing the aft floor board 114 (while the side floats 120 are in place and the multi-purpose personal watercraft 100 is in user), a user of the multi-purpose personal watercraft 100 can place their feet or body in the water without fully exiting the boat, whether for leisure or for propulsion. Advantageously, allowing the selective removal of the aft floor board 114, adapts the multi-purpose personal watercraft 100 for easing the entry and exit of the multi-purpose personal watercraft 100 for those with disabilities or who otherwise are uncomfortable entering and exiting over the side of the multi-purpose personal watercraft 100.

The aft floor board 114 additionally includes a drive well slot 114' defining an aperture in the aft floor board 114 that is sized and shaped to receive a navigation and/or propulsion attachment, such as a conventional pedal driven propeller assembly (not shown), such that the pedal driven propeller assembly is held upright in the aft floor board 114 with its propellers extending below the bottom surface of the aft floor board 114 (where they can extend into water) and its pedals positioned above the top surface of the aft floor board 114 (where they are accessible to a user on top of the base frame 110). In this regard, the drive well slot 114' enables the placement and retention of a pedal driven propeller assembly. It is contemplated that the pedal driven propeller assembly may be fixed in the drive well slot 114' using a clamp or conventional motor bracket (not shown).

The base frame 110 additionally includes a bow portion 115 that includes a motor well 116 defining an aperture in the bow portion 115 that is sized and shaped to receive a navigation and/or propulsion attachment, such as a conventional trolling motor 140, such that that the trolling motor 140 is held upright in the bow portion 115 with its propellers extending below the bottom surface of the bow portion 115 (where they can extend into water) and its control box and/or handle/tiller positioned above the top surface of the bow portion 115 (where they are accessible to a user on top of the base frame 110). In this regard, the motor well 116 enables the placement and retention of a conventional trolling motor 140. It is contemplated that the pedal driven propeller assembly may be fixed in the motor well 116 using a clamp or conventional motor bracket (not shown).

In one embodiment, the bow portion 115 is detachable by way operation of a latch fastener (meaning it is coupled with the latch fastener) so that the base frame 110 may be configured with a seating area (defined as the base frame 110 minus with bow portion 115, side extensions 113, and aft floor board 114) facing away from the bow portion 115 or with the seating area facing towards the bow portion 115.

It is contemplated that when it is not desired to use a navigation and/or propulsion attachment in the drive well slot 114', or when it is not desired to use a navigation and/or propulsion attachment in the motor well 116, the drive well slot 114' and/or the motor well 116 each may be covered with an attachable frame cover to eliminate the potential for people or items to fall through an uncovered drive well slot 114' and/or motor well 116.

In one embodiment, the multi-purpose personal watercraft 100 includes a navigation and/or propulsion attachment that defines an attached rudder assembly 130. It is contemplated that the rudder assembly 130 is attached to the watercraft 100 through the use of a rigid cross bar that is attachable at either side to each side float 120 using a mechanical fastener, such as a screw. In one embodiment, the rudder assembly 130 is clamped to the cross bar at a location between the side floats 120.

It is appreciated that by attaching the rudder assembly 130 to both side floats 120, it can be more securely held in place and be centered in the rear of the multi-purpose personal watercraft 100. In the one embodiment, the rudder assembly employs a pulley system for control, thereby enabling more efficient control thereof.

The multi-purpose personal watercraft 100 includes an integrated dual steering system 150 that may be used to control steering through a navigation and/or propulsion device or multiple separate navigation and/or propulsion attachment. It is contemplated that such a navigation and/or propulsion attachment may include the rudder assembly 130 having a mechanical control interface and an attached trolling motor 140 that includes an mechanical control interface, with each mechanical control interface being defined by a pulley system operative to turn the rudder or motor, respectively.

In an alternate embodiment, the integrated dual steering system 150 may connect to a rudder assembly 130 having an electrical control interface and an attached trolling motor 140 that includes an electrical control interface (collectively, a "steering device"). In the one embodiment, the dual steering system 150 includes two discrete handles, each which may be wired to a single navigation and/or propulsion attachment to allow each to be controlled individually with electrical signals from the dual steering system 150.

In one embodiment, a second seating area may be used the base frame 110 instead of an aft floor board 114.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A multi-purpose personal watercraft, comprising:

a base frame defining a watercraft base having a deck side, a hull side, a bow portion and a detachable aft floor board; and two detachable mirror image side floats secured to the hull side of said base frame and to each other, wherein each of said detachable mirror image side floats are curved such that a first side float of the detachable mirror image side floats extends along a starboard side of the watercraft base and contours around the bow portion and a second side float of the detachable mirror image side floats extends along a port side of the watercraft base and contours around the bow portion; and wherein said base frame includes two detachable side extensions, positioned such that a first side extension of the detachable side extensions is positioned on and defines a part of the starboard side of the base frame and a second side extension of the detachable side extension is positioned on and defines a part of the port side of the base frame.

2. The multi-purpose personal watercraft of claim 1, wherein said detachable aft floor board includes a drive well slot sized and shaped to receive and hold a first navigation/propulsion attachment having propellers in an upright orientation such that propellers on the navigation/propulsion attachment having propellers extend below the base frame.

3. The multi-purpose personal watercraft of claim 2, wherein said first navigation/propulsion attachment is defined by a pedal driven propeller assembly.

4. The multi-purpose personal watercraft of claim 1, wherein said bow portion includes a motor well sized and shaped to receive and hold a second navigation/propulsion attachment having propellers in an upright orientation such that propellers on the second navigation/propulsion attachment having propellers extend below the base frame.

5. The multi-purpose personal watercraft of claim 4, wherein said second navigation/propulsion attachment is defined by a trolling motor.

6. The multi-purpose personal watercraft of claim 1, additionally comprising a third navigation/propulsion attachment integral with the detachable mirror image side floats and positioned behind the base frame beyond the aft-most part of the base frame.

7. The multi-purpose personal watercraft of claim 6, wherein said third navigation/propulsion attachment defines a rudder assembly.

8. A multi-purpose personal watercraft, comprising:

a base frame defining a watercraft base having a deck side, a hull side, a bow portion, and a detachable aft floor board, wherein said base frame includes two detachable side extensions, positioned such that a first side extension of the detachable side extensions is positioned on and defines a part of the starboard side of the base frame and a second side extension of the detachable side extension is positioned on and defines a part of the port side of the base frame;

wherein said detachable aft floor board includes a drive well slot sized and shaped to receive and hold a first navigation/propulsion attachment having propellers in an upright orientation such that propellers on the first navigation/propulsion attachment having propellers extend below the base frame;

wherein said bow portion includes a motor well sized and shaped to receive and hold a second navigation/propulsion attachment having propellers in an upright orientation such that propellers on the second navigation/propulsion attachment having propellers extend below the base frame; and two detachable mirror image side floats secured to the hull side of said base frame and to each other, wherein each of said detachable mirror image side floats are curved such that a first side float of the detachable mirror image side floats extends along a starboard side of the watercraft base and contours around the bow portion and a second side float of the detachable mirror image side floats extends along a port side of the watercraft base and contours around the bow portion.

9. The multi-purpose personal watercraft of claim 8, wherein at least one of said first navigation/propulsion attachment and said second navigation/propulsion attachment is defined by a pedal driven propeller assembly.

10. The multi-purpose personal watercraft of claim 8, wherein at least one of said first navigation/propulsion attachment and said second navigation/propulsion attachment is defined by a trolling motor.

11. The multi-purpose personal watercraft of claim 8, additionally comprising a third navigation/propulsion attachment integral with the detachable mirror image side floats and positioned behind the base frame beyond the aft-most part of the base frame.

12. The multi-purpose personal watercraft of claim 11, wherein said third navigation/propulsion attachment defines a rudder assembly.

13. The multi-purpose personal watercraft of claim 12, wherein at least one of said first navigation/propulsion attachment and said second navigation/propulsion attachment is defined by a trolling motor.

14. The multi-purpose personal watercraft of claim 13, additionally comprising a dual steering system operatively connected to the rudder assembly and trolling motor.

* * * * *